United States Patent [19]

Whiteside

[11] Patent Number: 4,817,913

[45] Date of Patent: Apr. 4, 1989

[54] FLUSHOMETER RELIEF VALVE

[75] Inventor: John F. Whiteside, Franklin Park, Ill.

[73] Assignee: Sloan Valve Company, Franklin Park, Ill.

[21] Appl. No.: 242,549

[22] Filed: Sep. 12, 1988

[51] Int. Cl.[4] ..... F16K 31/145

[52] U.S. Cl. ..... 251/40; 92/103 F; 92/243; 138/40; 251/298; 251/900

[58] Field of Search ..... 138/40, 41, 42; 251/38, 251/39, 40, 41, 42, 43, 44, 118, 120, 900

[56] References Cited

U.S. PATENT DOCUMENTS

| | | | |
|---|---|---|---|
| 174,280 | 2/1876 | Mooney | 92/243 |
| 2,210,860 | 8/1940 | Regnell | 251/40 |
| 2,255,322 | 9/1941 | Langdon | 251/40 |
| 2,406,259 | 8/1946 | Russell et al. | 251/40 |
| 2,920,655 | 1/1960 | Dwyer | 92/103 F |
| 3,428,965 | 2/1969 | Achey | 251/40 |
| 3,435,734 | 4/1969 | Bushway | 92/103 F |
| 3,493,147 | 2/1970 | Ballin | 92/243 |
| 3,988,001 | 10/1976 | Kankaras | 251/298 |
| 4,261,545 | 4/1981 | Allen | 251/40 |
| 4,327,891 | 5/1982 | Allen et al. | 251/40 |

*Primary Examiner*—George L. Walton

*Attorney, Agent, or Firm*—Kinzer, Plyer, Dorn, McEachran & Jambor

[57] ABSTRACT

This invention relates to a flexible diaphragm assembly for use in a flush valve having a hollow body, an inlet, an outlet, a valve seat formed in the body between the inlet and outlet, and an operating handle assembly. The diaphragm assembly includes a diaphragm adapted to be peripherally attached to the flush valve body and a barrel integral with the diaphragm. The barrel has a seat member on its exterior positioned for sealing engagement with the body valve seat. There is an annular valve seat on the interior of the barrel and a relief valve is positioned within the barrel and has a seat portion positioned to close upon the barrel valve seat. The relief valve has an annular flexible lip in contact with the interior of the barrel and spaced from the relief valve seat portion. The relief valve further has a stem extending outwardly from the barrel and positioned for contact by the flush valve handle assembly.

18 Claims, 1 Drawing Sheet

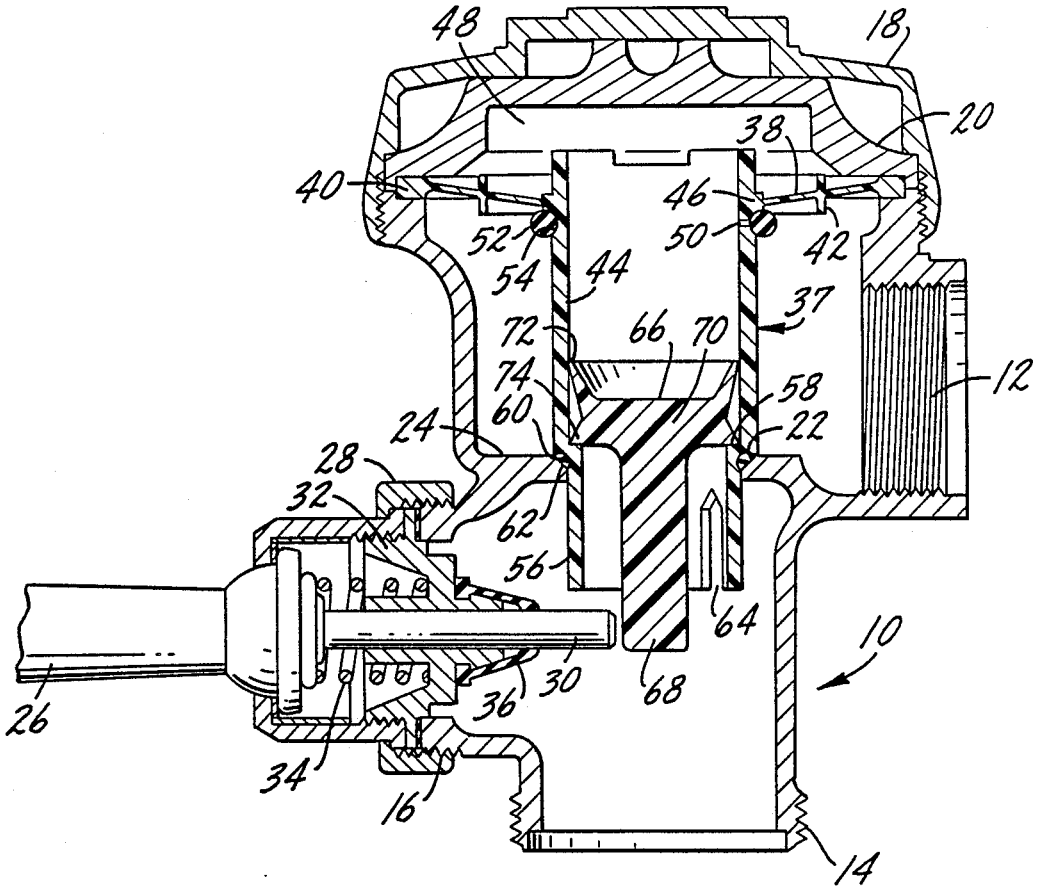
48
18
20
38
40
46
52
50
42
54
44
37
72
66
70
74
58
12
60
22
24
28
32
62
56
64
10
26
30
36
68
34
16
14

FLUSHOMETER RELIEF VALVE

SUMMARY OF THE INVENTION

The present invention relates to a flush valve of the type used in commercial washrooms and in particular to an improved flexible diaphragm assembly for use in such a flush valve.

A primary purpose of the invention is a flush valve of the type described which has an improved diaphragm assembly, substantially reducing the number of components within the flush valve, thereby reducing piece-part costs, labor assembly costs and inventory costs.

Another purpose is a reliably operable flexible diaphragm assembly of the type described in which all of the parts are formed of a suitable plastic.

Other purposes will appear in the ensuing specification, drawing and claims.

BRIEF DESCRIPTION OF THE DRAWINGS

The invention is illustrated diagrammatically in the attached drawing illustrating a preferred embodiment of the invention.

DESCRIPTION OF THE PREFERRED EMBODIMENT

The present invention is assigned to the assignee of U.S. Pat. No. 4,327,891, Sloan Valve Company, of Franklin Park, Ill., which manufactures and sells flush valves for use in commercial washrooms of several types, including those sold under the trademarks ROYAL and CROWN. The '891 patent shows a flush valve of the type sold under the trademark ROYAL and the present invention is specifically directed to a diaphragm assembly which may be usable in the flush valve of the '891 patent. The diaphragm assembly is substantially improved over that shown in the prior art, particularly in reducing the number of parts, and in forming the diaphragm assembly out of parts which may be easily molded from one of the new generation of plastics, specifically a plastic sold by DuPont under the trademark HYTREL.

In the drawing, the flush valve has a generally hollow body 10 which includes an inlet connection 12, an outlet connection 14 and a handle coupling connection 16. The top of the valve body is closed by an outer cover 18 and an inner cover 20. The inlet portion of the valve is separated from the outlet portion by a valve seat 22 formed at the termination of an inwardly-extending annular body flange 24.

The valve is actuated by an operating handle 26 which is fastened to the valve body 10 by means of coupling nut 28. The handle is connected to a plunger 30 which extends into the interior of the valve body. Plunger 30 is guided and supported by a bushing 32 and restored by a spring 34. A rubber sealing cap or grommet 36 is snapped on the end of bushing 32 and prevents leakage outward from the handle opening.

Positioned within the flush valve body 10 is a diaphragm assembly indicated generally at 37 which includes an annular flexible diaphragm 38, having an enlarged portion 40 at its periphery which is fixed to the flush valve body between inner cover 20 and an annular shoulder on the flush valve body. Diaphragm 38 may have one or more reinforcing rings 42 positioned intermediate the central area of the diaphragm and the enlarged portion 40. Reinforcing rings 42 may extend axially from both sides of diaphragm 38.

Integral with diaphragm 38 and a part of the diaphragm assembly 36 is a barrel 44 which is integrally molded to the diaphragm as at 46. The diaphragm and inner cover 20 define an upper chamber 48. There is a bypass orifice 50 in the wall of barrel 44 directly adjacent diaphragm 38 and a seal ring 52 extends about the barrel in a groove 54, with the seal ring in part masking the bypass orifice, but permitting the passage of water therethrough.

Barrel 44 has a portion 56 of reduced inner and outer diameter. On the inside of the barrel there is a relief valve seat 58 formed at the end of the portion of reduced diameter and on the exterior of the barrel there is similarly positioned a small groove 60 which contains a seal ring 62 which closes upon valve body seat 22 when the flush valve is in the closed position of the drawing. The barrel may have a plurality of axially-extending flow control slots 64, if desired.

Positioned within barrel 44 is a relief valve 66 which has a stem 68 positioned for contact by plunger 30. The enlarged body 70 of the relief valve has an outwardly-extending flexible lip 72 which is in sealing engagement with the interior of the barrel. Spaced from lip 72 is a second outwardly-extending lip 74 which has a lower surface thereof positioned upon barrel relief valve set 58 when the flush valve is in the closed position of the drawing.

The operation of the flush valve is as follows:

The drawing illustrates the closed position. Water from inlet 12 will normally seep through bypass orifice 50 into upper chamber 48 above the relief valve. Since the surface area subjected to inlet water pressure is greater on the upper side of the diaphragm than on the lower side, water pressure holds the diaphragm on valve seat 22 and water pressure also holds the relief valve on barrel relief valve seat 58. When a user pivots handle 26 in any direction, plunger 30 moves inwardly, tilting stem 68, which has the effect of unseating the relief valve from barrel seat 58 and, at least in part, moving annular sealing lip 72 away from the interior surface of barrel 44. This relieves the pressure in upper chamber 48 and causes the diaphragm assembly consisting of the diaphragm, barrel and relief valve to raise up, thereby creating a direct connection between inlet 12 and outlet 14.

When the diaphragm assembly so moves, relief valve 66 will again close on relief valve seat 58, closing off the upper chamber. Water seeping through orifice 50 will, in time, cause the diaphragm assembly to return to the closed position of the drawing. This provides a measured volume of water for flushing a toilet or urinal.

Even if handle 26 should be held in an operable position, the diaphragm assembly will still close upon body valve seat 22. The holding open of the handle assembly will maintain the position of plunger 30 beneath valve stem 68, but there will still be a seal between the exterior of the relief valve and the interior of the barrel because annular lip 72 will always bear against the interior of the barrel, except at that instant when the relief valve is unseated at initial operation of the flush valve.

Preferably, the diaphragm and barrel, as well as the relief valve, are formed of a suitable plastic and the plastic HYTREL manufactured by DuPont has been found to be satisfactory, although the invention should not be limited to any particular plastic. By forming the barrel and diaphragm as a single unit, there is a substantial reduction in the number of parts of the diaphragm assembly, when compared with the flush valve shown in the above-mentioned '891 patent. The same is true of the relief valve. The savings brought about by a reduced number of parts is substantial. Less parts must be manufactured, there is a substantially reduced time for assembly and a substantial reduction in the number of parts which must be inventoried for repair, all leading to flush valve equally efficient in operation with flush valves in the prior art, but vastly less expensive to manufacture.

The use of plastic components provides a flush valve in which the internal parts thereof will have a substantially extended life, when contrasted with prior art flush valves having a number of metal fittings.

Although the invention shows a single stress control ring molded into the diaphragm, there may be more than one such ring, and those portions of the ring extending away from the diaphragm on opposite sides thereof, instead of being aligned, could be offset.

Whereas the preferred form of the invention has been shown and described herein, it should be realized that there may be many modifications, substitutions and alterations thereto.

The embodiments of the invention in which an exclusive property or privilege is claimed are as follows:

1. In a flush valve of the type having a hollow body, an inlet, an outlet, a valve seat formed in the body between the inlet and outlet, a diaphragm peripherally fixed to said flush valve body, a barrel, integral with said diaphragm, a seal member on the exterior of said barrel and positioned to close upon said valve seat, an annular valve seat on the inside of said barrel, a relief valve positioned for movement within said barrel and having an exterior portion thereof formed and adapted to close upon said barrel valve seat, said relief valve having an annular outwardly-extending flexible deformable lip spaced from said exterior portion and in sealing contact with the interior of said barrel, an annular space being defined between and by said flexible lip and said exterior portion, said flush valve having an operating handle assembly, a portion of which is formed and adapted to contact and tilt said relief valve, causing a portion of said relief valve exterior portion to move away from said barrel valve seat and causing a portion of said relief valve lip to move away from the interior of said barrel thereby opening a flow communication between the moved portions of said flexible lip and said exterior portion and through said annular space to provide for operation of said flush valve.

2. The flush valve of claim 1 further characterized by and including a bypass orifice in said barrel, and a seal member positioned at said bypass and extending about the exterior of said barrel.

3. The flush valve of claim 2 further characterized in that said bypass orifice is closely adjacent to said diaphragm.

4. The flush valve of claim 1 further characterized in that said barrel has portion thereof of reduced exterior diameter, said barrel exterior seal member being positioned about said barrel in the area of said portion of reduced diameter.

5. The flush valve of claim 4 further characterized in that said body valve seat is annular and is of a size to receive only that portion of the barrel having a reduced exterior diameter.

6. The flush valve of claim 1 further characterized in that said diaphragm has an integral stress control ring formed therein intermediate the barrel and the exterior of said diaphragm.

7. The flush valve of claim 1 further characterized in that said relief valve has an axial stem extending beyond said barrel and positioned to be contacted by said portion of said operating handle assembly.

8. The flush valve of claim 1 further characterized in that said barrel has a plurality of axially extending, circumferentially positioned, flow control slots formed therein.

9. A flexible diaphragm assembly for use in a flush valve having a hollow body, an inlet, an outlet, a valve seat formed in the body between the inlet and outlet, and an operating handle assembly, said diaphragm assembly including a diaphragm adapted to be peripherally attached to the flush valve body, a barrel integral with said diaphragm and having a seal member on the exterior thereof positioned for sealing engagement with said body valve seat, an annular valve seat on the interior of said barrel and a relief valve positioned within said barrel and having a seat portion thereof positioned to close upon said barrel valve seat, said relief valve having an annular flexible distortable lip in contact with the interior of said barrel and spaced from said relief valve seat portion, an annular space being defined between and said flexible lip and said seat portion, said relief valve having a stem extending outwardly from said barrel and positioned for tilting contact by the flush valve handle assembly, causing a portion of said relief valve seat portion to move away from said barrel valve seat and causing a portion of said relief valve lip to move away from the interior of said barrel thereby opening a flow communication between the moved portions of said flexible lip and said seat portion and through said annular space to provide for operation of said flush valve.

10. The flexible diaphragm assembly of claim 9 further characterized by and including a bypass orifice in said barrel.

11. The flexible diaphragm assembly of claim 10 further characterized by and including an annular seal member positioned about said barrel and at least in par masking said bypass orifice.

12. The flexible diaphragm assembly of claim 9 further characterized by and including a stress control ring, integrally formed with said diaphragm.

13. The flexible diaphragm assembly of claim 12 further characterized in that said stress control ring is generally intermediately positioned on said diaphragm and has portions extending axially in both directions from said diaphragm.

14. The flexible diaphragm assembly of claim 9 further characterized in that the exterior of said barrel has a portion of reduced diameter, said barrel seal member being positioned about said barrel portion of reduced diameter.

15. The flexible diaphragm assembly of claim 9 further characterized in that said barrel has a portion of reduced interior diameter, with said barrel valve seat being positioned at the termination of said barrel portion of reduced interior diameter.

16. The flexible diaphragm assembly of claim 15 further characterized in that said barrel portion of reduced interior diameter has a plurality of axially-extending flow control slots formed therein.

17. The flexible diaphragm assembly of claim 9 further characterized in that said relief valve seat portion is directly adjacent said relief valve stem, with said relief valve flexible lip being formed at the end of said relief valve away from said relief valve stem.

18. The flexible diaphragm assembly of claim 9 further characterized in that said diaphragm, barrel, and relief valve are all formed of plastic.

* * * * *